United States Patent [19]

Orlandi

[11] 3,955,348

[45] May 11, 1976

[54] WIRE CABLER

[75] Inventor: John F. Orlandi, Lombard, Ill.

[73] Assignee: Belden Corporation, Geneva, Ill.

[22] Filed: Feb. 3, 1975

[21] Appl. No.: 546,633

[52] U.S. Cl. ..... 57/13; 57/15; 57/58.32; 57/59

[51] Int. Cl.[2] ..... D07B 3/04; D07B 3/06

[58] Field of Search ..... 57/13–18, 57/58.3–58.38, 58.49, 58.52–58.55, 58.63, 58.81, 58.83, 59, 60, 64, 65, 160, 161, 166

[56] References Cited

UNITED STATES PATENTS

| | | | |
|---|---|---|---|
| 1,659,565 | 2/1928 | Finkelstein | 57/58.36 X |
| 1,866,272 | 7/1932 | Seeley | 57/58.52 |
| 2,464,860 | 3/1949 | Green | 57/58.52 |
| 2,920,437 | 1/1960 | Stark | 57/17 |
| 3,827,225 | 8/1974 | Schoerner | 57/13 |

*Primary Examiner*—Donald E. Watkins
*Attorney, Agent, or Firm*—Fitch, Even, Tabin & Luedeka

[57] ABSTRACT

A wire cabler is described in which wire is deployed from rotating spools supported on an oppositely rotating frame in a manner which causes the wire to pass in engagement with the circumferential edges of the spools. The relative rotation of the spools and the rotating frame is such that the twist imparted to the wire is substantially equal but in opposite directions for full and nearly empty spools.

7 Claims, 6 Drawing Figures

WIRE CABLER

This invention relates to wire cablers and, more particularly, to an improved wire cabler which allows the use of finer wires, larger capacity spools and faster speeds than is possible in prior art apparatus.

Various kinds of wire cablers have been designed for the purpose of forming cable of various types and sizes. One successful wire cabler is known to those skilled in the art as a planetary cabler and employs a plurality of spools mounted on a rotary frame. As the frame rotates in one direction the spools, by suitable gearing, are driven in the opposite direction and at the same rotational speed as the frame. The wire is drawn from the rotating spools through a guide plate and into a die where cabling is accomplished.

Although highly successful, certain limitations do exist in known apparatus of the described type. In particular, there has existed in such apparatus a limitation on speed at which cabling could be effected, particularly in the case of very fine wire diameters. Such limitations are generally the result of problems connected with vibration and pulsation.

It is an object of the present invention to provide an improved wire cabler.

Another object of the invention is to provide a wire cabler which allows the use of finer wires at faster speeds than known apparatus.

Another object of the invention is to provide a wire cabler wherein problems resulting from vibration and pulsation are minimized.

Other objects of the invention will become apparent to those skilled in the art from the following description, taken in conjunction with the accompanying drawings wherein.

Figure 1:
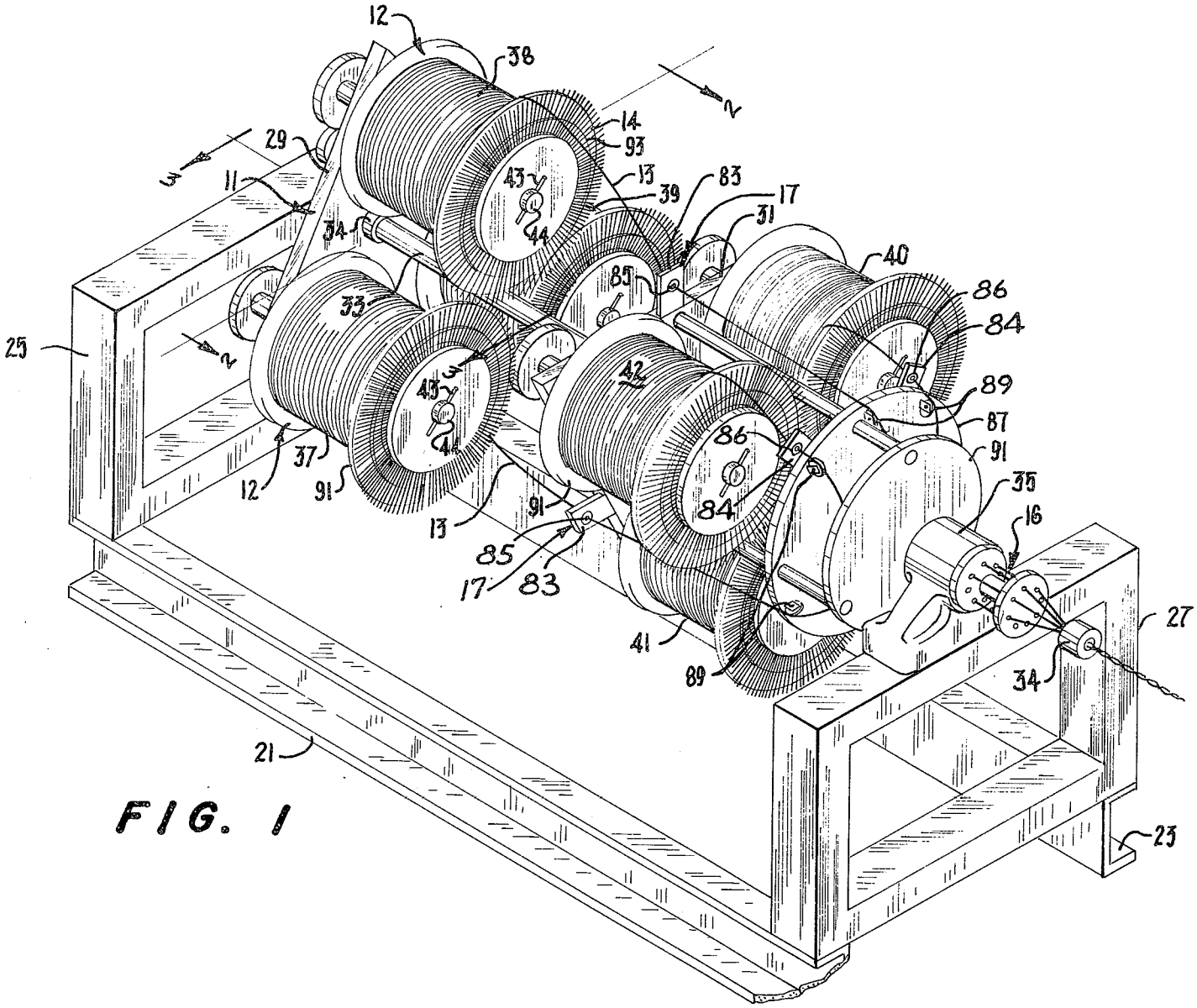
FIG. 1 is a perspective view of a wire cabler constructed in accordance with the invention.

Very generally, the wire cabler of the invention comprises frame means 11 which are rotatable about an axis. Spool means 12 are supported on the frame means. Cable wire 13 is wound on the spool means. The spool means have at least one circumferential edge portion 14 the periphery of which is spaced radially outward of the wire wound on the spool means with respect to the axis of the spool means. The spool means are rotated about an axis which extends in the same direction as the axis of the frame means and the rotation thereof is in a direction opposite to that of the frame means. A cabling head 16 is also provided and guide means 17 on the frame means guide the wire to the cabling head. The guide means are positioned to cause the wire to pass from the spool means in contact with the edge portion thereof. The frame rotating means and the spool rotating means are of a configuration to rotate the frame means and the spool means at a relative rate such that twist imparted to the wire is substantially equal but in opposite directions for full and nearly empty spool means.

Referring now more particularly to FIG. 1, the embodiment of the invention illustrated therein includes a support structure comprised of a pair of horizontal channel beams 21 and 23 which support a pair of spaced end structures 25 and 27.

In the illustrated embodiment, the frame means 11 comprise a pair of triangular members 29 and 31 spaced along a shaft 33. The members 29 and 31 are equilateral triangles oriented with their apexes shifted 120°. The shaft 33 is journalled in a bearing 34 supported on the member 29, and in a further bearing block, not shown, supported within a housing 35 mounted to the structure 27.

The spool means 12 in FIG. 1 comprise six spools 37, 38, 39, 40, 41 and 42. The first three are mounted on the triangular member 29 for rotation thereon by means of axles 44 and retaining pins 43. The spools 40, 41 and 42 are similarly mounted on the member 31 for rotation with respect thereto. The spool means rotate about an axis which extends in the same direction as the axis of the frame means, and their rotational direction is opposite to that of the frame means.

Figure 2:
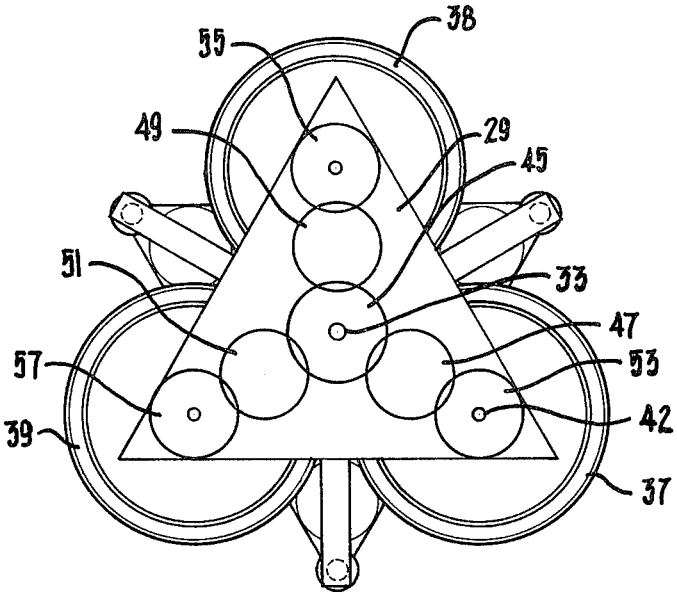
FIG. 2 is a sectional view taken on a plane through the line 2—2 of FIG. 1.

The rotation is accomplished by a gear arrangement which may be seen more clearly in FIG. 2. The arrangement shown in FIG. 2 is mounted on the triangular member 29, however, it is to be understood that the gear arrangement mounted on the triangular member 31 is identical. The gear arrangement includes a sun gear 45 which is mounted on the shaft 33 for rotation therewith. The gear 45 is rotated as described below and rotates the corresponding gear on the member 31 to rotate the spools 40, 41 and 42 thereon. Planetary idler gears 47, 49 and 51 are mounted to the member 29 for rotation and are in engagement with the sun gear 45. Drive gears 53, 55 and 57 are mounted to the triangular member 29 and engage the planetary idler gears 47, 49 and 51, respectively. Each of the gears 53, 55 and 57 is keyed on the shaft 42 for the respective spools 37, 38 and 39 to thereby drive the spools 37, 38 and 39.

Figure 3:
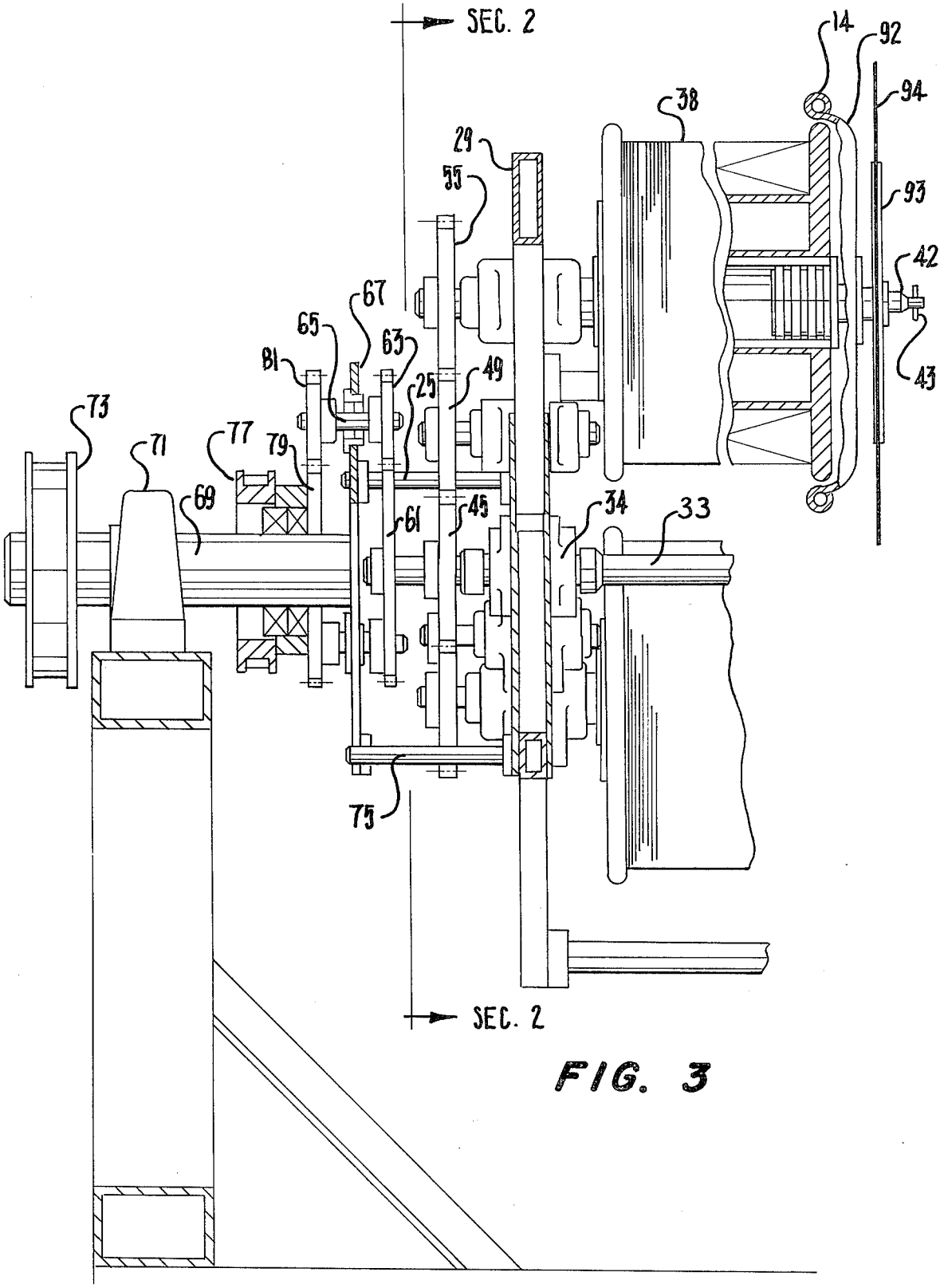
FIG. 3 is a sectional view taken on a plane through the line 3—3 of FIG. 1.

Referring to FIG. 3, the means by which rotation of the frame means and the spool means 14 is effected may be more clearly seen. The shaft 33 and the gear 45 are driven by a drive gear 61. Three peripheral gears 63 are spaced at 120° intervals around the gear 61 and are mounted on the shaft 65. The shaft 65 is journalled in a fixed plate 67 which is drivingly attached to the end of a drive shaft 69. The drive shaft 69 is supported in a bearing block 71 and is driven by a drive pulley 73 from a suitable motor and pulley drive system, not shown. Three posts 75 extend from the plate 67 at 120° intervals and are fixed to the member 29. Rotation of the shaft 69 by means of the pulley 73 therefore causes rotation of the plate 67 and hence rotation of the member 29. This causes rotation of the frame means 11.

In order to provide for rotation of the spool means in the opposite direction from the rotation of the frame means, a spool means drive pulley 77 is mounted on the shaft 69 for free rotation with respect thereto. The pulley 77 is coupled to a gear 79 which, in turn, drives three planet gears 81 located at 120° intervals around the gear 79. Rotation of the gears 81 drives the gears 63 through the shaft 65, thereby causing rotation of the gear 61 and therefore rotation of the pulleys are previously described. By rotating the gears 77 at a suitable rate and direction, the direction of rotation and the speed of rotation of the spools relative to that of the frame means may be carefully regulated.

The wire 13 passes off of the spools 37–42 and is guided to the cabling head 16 by the guide means 17. The guide means in the embodiment of FIGS. 1–2 include a plurality of brackets 83 and 84 mounted on the triangular member 31 and on a disc 87 located at the far end of the frame means 11 between the spools 40, 41 and 42 and the cabler head 16. The brackets 83 and 84 contain wire guides 85 and 86 through which the wire passes. Each of the wires then passes over a separate pulley 89 mounted on the disc 87 and then through an associated guide, no visible, in a plate 91. The plate 91 rotates with the disc 87 and the pulleys thereon and the wires pass from there into the cabler head 16 and then into a stationary die 34. From there, the wires are drawn outwardly by suitable means, not shown. If desired, a central wire, not shown, may pass axially through the shaft 33, which is hollow, and through an axially aligned opening in the cabling head.

Each of the spools has a pair of spaced rims or edge portions 14. As may be seen in detail in FIG. 3, the edge portions in the illustrated embodiment are comprised of an assembly which includes an aluminum disc 92 and a whisker disc 93. The aluminum disc has a generally tubular edge which fits over the rim of the spool proper in order to provide a smooth surface in contact with the wire and thus prevent damage resulting from nicks or other irregularities. The whisker disc 93 includes a plurality of resilient filaments 94 extending in a radial direction from the disc and is used to provide tension for the wire in the cabling operation. Both the disc 92 and the whisker disc 93 are mounted on the shafts 42 and rotate therewith.

As a result of the wire being drawn off the spools in contact with the edge portions 14, much finer tension control and operating speeds are attainable due to the reduction of pulsation and vibration in the wire which might cause the wire to stretch or break. Also, finer diameter wire may be used. Although a twist is imparted to the wire, the effect of the twist may be minimized by driving the reels or spools at a speed relative to the frame such that a full spool provides a twist which is very small in one direction, and a nearly empty spool provides a slight twist which is in the opposite direction. When the spool is one-half full, there is no twist during the short period of change over of twist directions.

Figure 5:
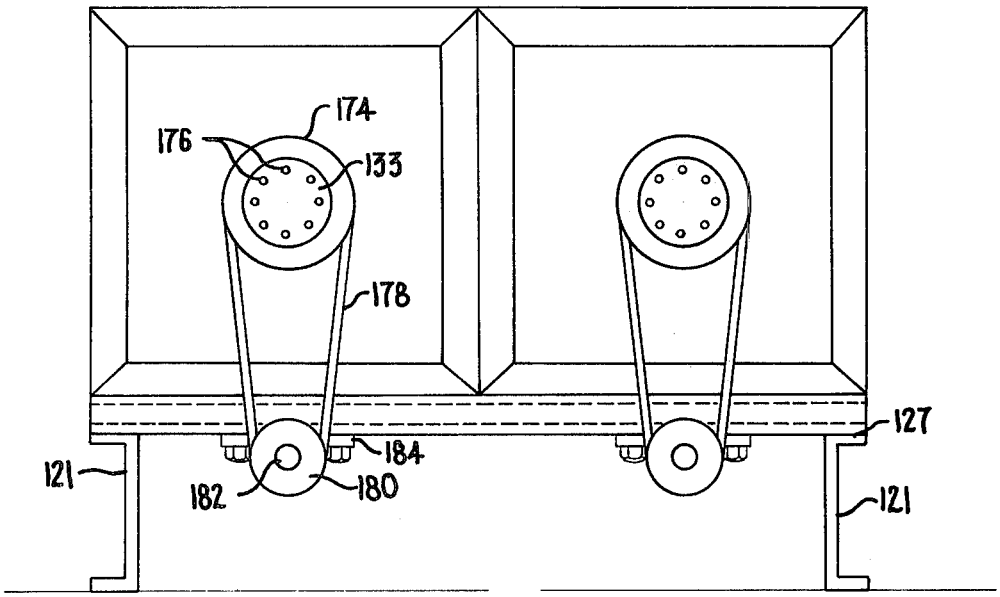
FIG. 5 is an end view of the apparatus of FIG. 4.
Figure 4:
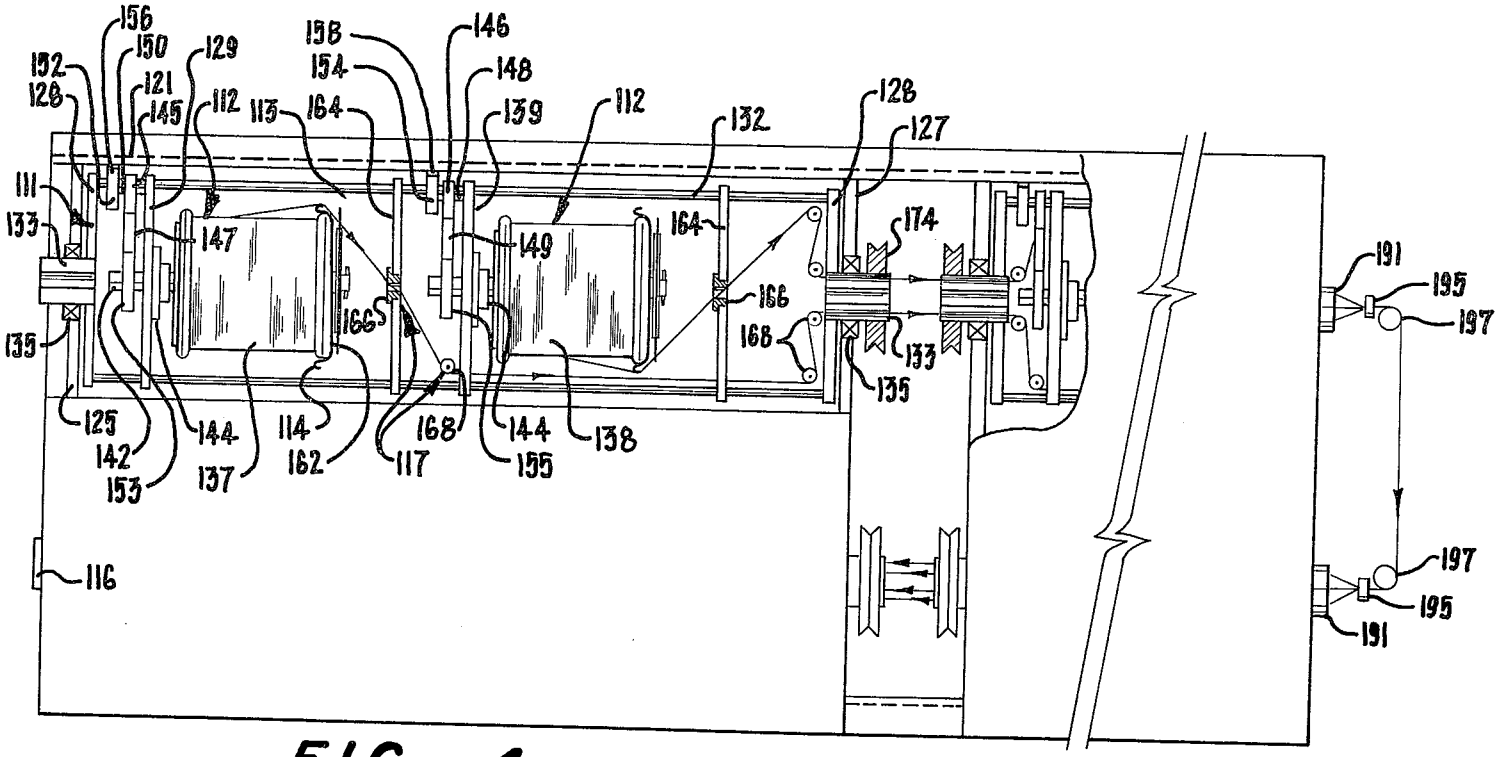
FIG. 4 is a top view illustrating a further embodiment of the invention.

Referring now to FIGS. 4 and 5, a further embodiment of the invention is shown. In this embodiment, rather than a planetary type arrangement of spools, all of the spools are arranged in line with a total of four spools aligned in one direction and four spools aligned in the opposite direction. More particularly, those items in the embodiment of FIGS. 4 and 5 which are similar in function and design to items in the embodiment of FIGS. 1 and 2 are indicated by the identical reference numbers preceded by a 1. Thus, the embodiment of FIGS. 4 and 5 include frame means which are rotated about an axis and which support spool means 112. Cable wire 113 is wound on the spool means and at least on circumferential edge portion 114 of the spool means is spaced radially outward of the wire with respect to the axis of rotation of the spool means. The spool means are rotated about their axes which extend in the same direction as the axis of the frame means, such rotation being in a direction opposite to that of the frame means. Th cabling head is shown generally at

116. Means 117 guide the wire to the cablig head in a manner which causes the wire to pass from the spool means in contact with the edge portions to impart a twist to the wire.

More particularly, in the illustrated embodiment, the frame means 111 are supported in a support structure 121 having spaced upright walls 125 and 127. There are four basic units to the apparatus of FIGS. 3 and 4, only one unit being illustrated completely. It should be understood that the units are substantially identical. Two units are oriented in line in one direction, and two units are oriented parallel to the first two but in the opposite direction.

The frame means 111 include spaced end plates 128 and spool support plates 129 and 131, all of which are tied together by tie beams 132. The plates 128 are mounted in suitable bearings 135 to rotate on sleeve-type shafts 133. The spools 137 and 138 are mounted with their axes aligned with the axis of rotation of the frame means 111. The spools are mounted on shafts 142 supported in the plates 129 and 131, respectively, by bearing housings 144. A gear 153 is mounted on the shaft 142 for rotating the spool 137, and a similar gear 155 is mounted on the associated shaft 142 for driving the spool 138. An idler gear 147 couples the gear 153 to a gear 145 which is mounted on a shaft 146. Similarly a gear 149 couples the gear 155 to the gear 146 on a drive shaft 148. A gear 152 is mounted on the drive shaft 150 and a similar gear 154 is mounted on the drive shaft 148. The gear 150 engages an annular gear 156 and the gear 154 engages an annular gear 158. Rotation of the frame causes the gears 156 and 158 to rotate the gears 152 and 154. This causes rotation of the spools through their associated gear trains in a direction opposite to the direction of rotation of the frame means.

For the purpose of guiding the wire 13 from the spools, guide plates 164 are mounted in the frame means. The guide plates 164 are provided with wire guide inserts 166 therein through which the wire passes. Pulleys 168 are mounted on the plates 131 for the purpose of guiding the wires axially along the frame means 111 toward the righthand end as viewed in FIG. 4.

In order to convey the various wires between the spool units, the pulleys are arranged to bring the wires inwardly so that they pass through axial openings in the sleeves 133. The pulleys 174 are mounted on the sleeves for the purpose of rotating the frame means 111. As may be viewed in FIG. 4, the holes are arranged in the sleeves 133, the holes being indicated at 176. A belt 178 passes over the pulleys 174 and around a pulley 180. The pulley 180 is mounted on a shaft 182 and secured by a bracket 184 to the underside of the frame support 127. Suitable means, not shown are provided for rotating the shafts 182 in order to drive the frame means as previously described.

Figure 6:
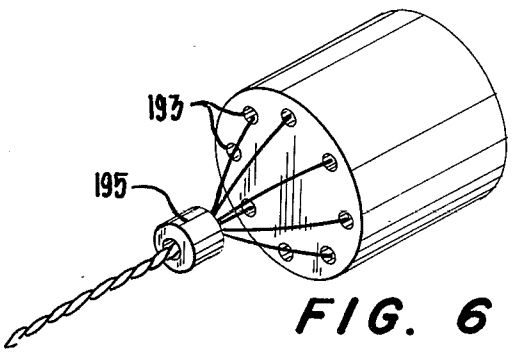
FIG. 6 is a perspective view of a wire gatherer which may be used in apparatus constructed in accordance with the invention.

After traveling to the right of FIG. 4, the wires from four spools are reversed in direction and passed back toward the left to complete the cabling from eight spools. To do this, a wire gatherer is provided, shown in FIG. 6, comprising a cylinder 191 in which are bored a plurality of holes 193 through which the wires pass. A gathering collar 195 is also provided for gathering the wires together to pass over transfer pulleys 197. As the wires pass to the other side, the process is reversed through the substantially identical units and the cabling continues as before.

By way of example, a typical wire cabler of the design illustrated in FIG. 1 may employ spools which have a seven inch diameter barrel upon which the wire is wound and, when full, have an eleven inch outer diameter of the wound wire. The ratio of the spool rpm to the frame rpm is determined by selecting appropriate gear ratios. Under these conditions, the following results have been achieved:

| | | NEARLY EMPTY SPOOL | | | | FULL SPOOL | | |
|---|---|---|---|---|---|---|---|---|
| CABLE LAY | Processing Wire Speed (Ft./Min.) | SPOOL RPM | WIRE RPM | TOTAL RPM | % ERROR | WIRE RPM | TOTAL RPM | % ERROR |
| ½ in. | 12.5 | 294.8 | 6.8 | 301.4 | .46 | 4.05 | 298.65 | .46 |
| 1 in. | 25 | 289.2 | 13.6 | 302.8 | .92 | 8.10 | 297.3 | .92 |
| 2 in. | 50 | 278.3 | 27.2 | 305.5 | .83 | 16.2 | 294.5 | 1.83 |

It may be seen, therefore, that the invention provides an improved wire cabler which may be of either the planetary or the in-line type of design and in which the use of finer wires at faster speeds is possible. Also, problems of vibration are significantly reduced.

Various modifications of the invention in addition to those shown and described herein will become apparent to those skilled in the art from the foregoing description and accompanying drawings. Such modifications are intended to fall within the scope of the appended claims.

What is claimed is:

1. A wire cabler comprising, frame means, means for rotating said frame means about an axis, spool means supported on said frame means, cable wire wound on said spool means, said spool means having at least one circumferential edge portion the periphery of which is spaced radially outward of said wound wire with respect to the axis of said spool means, means for rotating said spool means about its axis which extends in the same direction as the axis of said frame means, said rotation being in a direction opposite to that of said frame means, a cabling head, and guide means on said frame means for guiding said wire to said cabling head, said guide means being positioned to cause said wire to pass from said spool means in contact with said edge portion, said frame rotating means and said spool rotating means being of a configuration to rotate said frame means and said spool means at a relative rate such that the twist imparted to said wire is substantially equal but in opposite directions for full and nearly empty spool means.

2. A wire cabler according to claim 1 wherein the axis of said spool means is coaxial with the axis of said frame means.

3. A wire cabler according to claim 1 wherein the axis of said spool means is parallel with and spaced from the axis of said frame means.

4. A wire cabler according to claim 1 wherein said spool means comprise a plurality of spools.

5. A wire cabler according to claim 1 wherein said edge portion of said spool is comprised of a disc having a rounded periphery.

6. A wire cabler comprising, a support structure, a frame rotatably supported in said support structure for rotation about an axis, a plurality of spools supported on said frame for retation about axes which are parallel to and spaced equidistantly from the axis of rotation of said frame, cable wire wound on said spools, each of said spools having at least one circumferential edge portion the periphery of which is spaced radially outward of said wire with respect to the axis of said spools, a cabling head, guide means on said frame for guiding said wire from each of said spools to said cabling head, said guide means being positioned to cause said wire to pass from each of said spools in contact with the respective edge portions thereof, and means for rotating said spools and said frame means in opposite directions at a relative rate such that said edge portions impart a twist to said wire which is substantially equal but in opposite directions for full and nearly empty spools.

7. A wire cabler comprising, a support structure, a frame supported for rotation in said support structure about an axis, a plurality of spools supported for rotation on said frame coaxially therewith, cable wire wound on said spools, each of said spools having at least one circumferential edge portion the periphery of which is spaced outward of said wire with respect to the axis of said spool, a cabling head, guide means on said frame for guiding said wire to said cabling head, said guide means being positioned to cause said wire to pass from each of said spools in contact with the respective edge portions thereof and means for rotating said frame and said spools in opposite directions at a relative rate such that said edge portions impart a twist to said wire which is substantially equal but in opposite directions for full and nearly empty spools.

* * * * *

UNITED STATES PATENT AND TRADEMARK OFFICE

CERTIFICATE OF CORRECTION

PATENT NO. : 3,955,348

DATED : May 11, 1976

INVENTOR(S) : John F. Orlandi

It is certified that error appears in the above-identified patent and that said Letters Patent are hereby corrected as shown below:

Col. 3, line 13 "no visible" should be --not visible--.

Col. 3, line 62 "at least on" should be --at least one--.

Col. 3, line 68 "Th cabling" should be --The cabling--.

Col. 4, line 1 "cablig" should be --cabling--.

Col. 4, line 37 "wire 13" should be --wire 113--.

Col. 5 Table

| | % ERROR | | % ERROR |
|---|---|---|---|
| | | should be | |
| 2 in. | ".83" | | 2 in. --1.83-- |

Col. 6, line 21 "retation" should be --rotation--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*